United States Patent [19]

Gustavsson

[11] 4,041,858

[45] Aug. 16, 1977

[54] HOUSEHOLD COMPACTOR FOR WASTE MATERIALS

[75] Inventor: John Kenneth Crister Gustavsson, Savsjo, Sweden

[73] Assignee: Aktiebolaget Electrolux, Stockholm, Sweden

[21] Appl. No.: 586,148

[22] Filed: June 12, 1975

[30] Foreign Application Priority Data

June 13, 1974 Sweden ..... 7407789

[51] Int. Cl.[2] ..... B30B 15/00

[52] U.S. Cl. ..... 100/229 A; 53/124 B; 141/316; 220/63 R

[58] Field of Search ..... 100/229 A; 220/63 R, 220/65; 141/73, 80, 316, 390, 313, 314, 315, 317; 53/124 B, 261, 262

[56] References Cited

U.S. PATENT DOCUMENTS

| | | | |
|---|---|---|---|
| 1,705,064 | 3/1929 | Mitchell | 53/261 |
| 3,722,561 | 3/1973 | O'Leary | 141/316 |
| 3,727,546 | 4/1973 | McKinney | 100/229 A |
| 3,734,340 | 5/1973 | Ippolito | 220/63 R |
| 3,861,296 | 1/1975 | Clar | 100/229 A |
| 3,945,314 | 3/1976 | Hennells | 100/229 A |

*Primary Examiner*—Billy J. Wilhite
*Attorney, Agent, or Firm*—Alfred E. Miller

[57] ABSTRACT

A household compactor for compacting materials, such as kitchen waste, and having a detachable cylinder positioned above the bed plate and surrounded by a container in the form of a plastic bag. The bottom of the plastic bag also functions as the bottom of the cylinder. The cylinder is divided into two substantially identical parts which, under the action of springs, cause the end of the cylinder facing the bed plate to open up and the two parts of the cylinder are spaced from each other, as compared to the other end of the cylinder.

5 Claims, 4 Drawing Figures

HOUSEHOLD COMPACTOR FOR WASTE MATERIALS

BACKGROUND OF THE INVENTION

Household compactors for waste materials are known which are generally located under a counter in a kitchen and comprise a cabinet having a retractable door. The door in most installations has a bottom plate which follows the movement of the door. The bottom plate functions as a support for a rectangular or circular press device chamber which surrounds a special plastic or heavy duty paper container for receiving the waste to be compacted. When the door with the bottom plate and container has been moved into the cabinet, a compression cycle may be initiated thereby compacting the waste in the container. When the container is full of compacted waste material, it is removed from the chamber, which is then opened or expanded in the same way.

Compactors of the type described hereinabove have the drawback that they require a relatively expensive container of a special design which is adapted to be used in the chambers of a variety of compactors, as required.

In order to use common plastic or heavy paper bags in a household compactor, an inner cylindrical jacket must be utilized which functions to protect the plastic bag during the compression cycle of the compactor. It is required that the cylindrical jacket be flexible enough to permit the jacket to be removed from the plastic bag without entraining the waste therein. Because of this requirement the cylindrical jacket must be made of three separate, arcuate sections, which together form a press cylinder. In this arrangement, the sections are placed in a plastic bag before the compression cycle in order to protect it during the compression cycle. However, there are serious disadvantages to this construction and arrangement in that the removal of the sections from the plastic bag full of compacted refuse is an intricate, time-consuming and unclean operation. In addition, it is difficult to place the arcuate sections in the precise position in an empty plastic bag, prior to use of the compactor.

The present invention relates to a household compactor for waste material including a press device and a lower bed plate, the latter being movable between two positions in which one position the bed plate is in vertical alignment with the press unit and another position the bed plate is entirely removed from the press unit.

It is an object of the present invention to provide a detachable cylinder for a household compactor that is placed on or above the bed plate and functions during the compression cycle to be surrounded by a container in the form of a common plastic bag, or the like, the bottom of the bag additionally forming the bottom of the cylinder.

Another object of the present invention is to provide a cylinder which is divided into two parts that are movable under spring action so that the end of the cylinder facing the bed plate tends to form a larger opening than the opposite end thereof.

The invention will now be more fully described with reference to the accompanying drawings, in which.

DESCRIPTION OF THE PREFERRED EMBODIMENT

Figure 1:
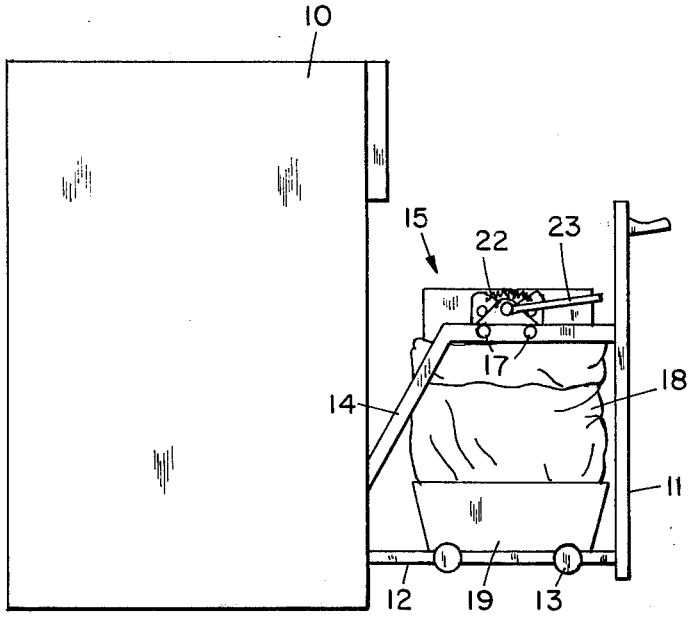
FIG. 1 is a front elevational view of a household compactor constructed in accordance with the teachings of the present invention showing the press cylinder and the plastic bag waste receptacle positioned on the bed plate.

A household compactor is seen in FIG. 1 having a cabinet 10 which encloses the press unit mechanism (not shown). The cabinet 10 is provided with a retractable door 11 and a horizontal bed plate 12. The latter is supported on rollers 13 for ease in operating the door, the rollers being movable in a well-known manner on rails in the cabinet (not shown). A pair of angle-shaped, elongated arms 14 extend from the inner part of the bed plate 12 (not shown) to the door 11 and function as a support for the hollow-ended press cylinder bearing the general reference numeral 15. Each arm 14 is provided with two semi-circular notches 16 for receiving the tubular guides 17, located at opposite sides of the press cylinder.

The press cylinder 15 is shown surrounded by a common plastic bag 18, the bottom of which forms the bottom of the hollow cylinder 15 and rests on the bed plate 12. A collar 19 secured to the bed plate serves as a centering and an enclosure means for the bottom of the cylinder 15 and the bag 18. It will be seen that the collar 19 is of a frustro-conical shape.

Figure 2:
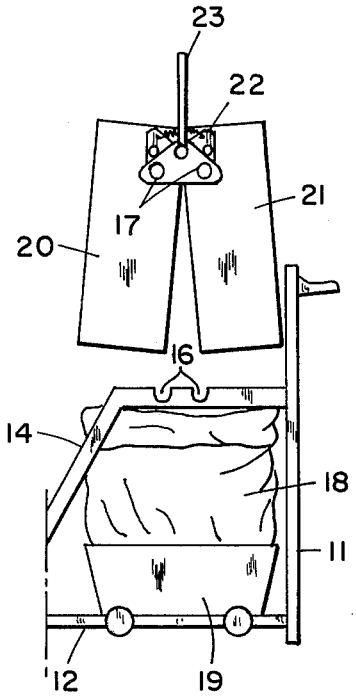
FIG. 2 is a front elevational view similar to FIG. 1 showing the press cylinder removed from the plastic bag.

The cylinder 15, as seen in FIG. 2, comprises two arcuate halves 20 and 21, the upper parts of which are pivotally interconnected by a device 22 that also functions to hold the halves together. This device additionally includes a handle 23 by which the cylinder 15 can be removed from the plastic bag 18, if desired.

Referring to FIG. 2, it will be noted that the plastic bag 18, with the compacted waste material therein remains on the bed plate 12 when the cylinder 15 is lifted out of the bag by means of the handle 23. Furthermore, the lower ends of the two cylinder halves 20 and 21 have been spaced apart by the action of the spring 31, thereby facilitating the lifting of the cylinder 15 out of the respective plastic bag 18.

Figure 3:
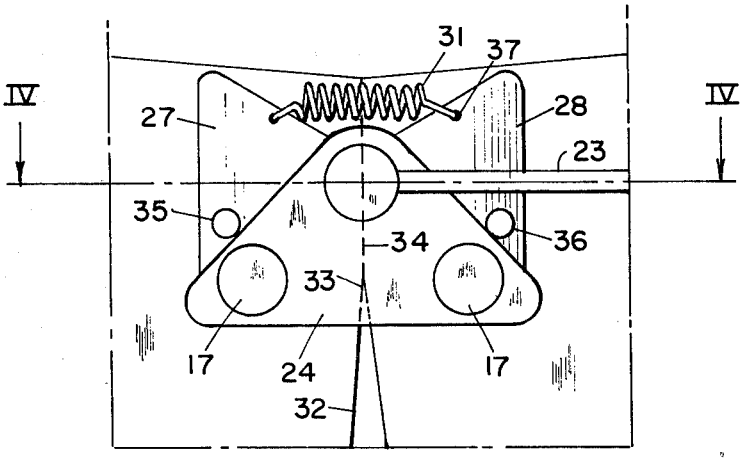
FIG. 3 is an elevational view of part of the top of the press cylinder, shown on an enlarged scale.
Figure 4:
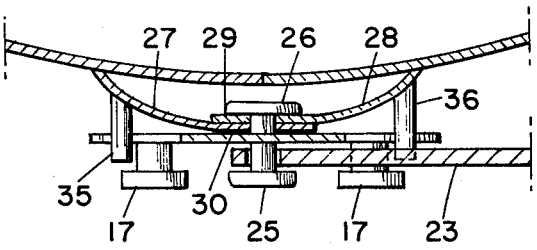
FIG. 4 is a sectional view taken along the lines IV—IV of FIG. 3.

Referring particularly to FIGS. 3 and 4, the device 22 comprises two cam discs 24 (only one of which is shown) disposed on opposite sides of the cylinder. Both of the cam discs are identical and are of a general triangular configuration, with each of the respective bases being generally parallel to the ends of the cylinder 15.

As seen in FIG. 4, the cam disc 24 adjacent to its upper apex is provided with two coaxial rivets 25 and 26 projecting from either side of the disc. One rivet 25 supports the handle 23 and the other rivet 26 is inserted through the lugs 27 and 28 projecting from the cylinder halves 20 and 21 and fastened to the latter. The opposed surfaces of the lugs 27 and 28 are provided with aligned holes 29 and 30 in which the rivet 26 is movable. The upper parts of the cylinder halves 20 and 21 are normally drawn together by means of the tension spring 31. The spring 31 is fixed at opposite ends to the lugs 27 and 28 respectively. Each cylinder half 20 or 21 is formed by dividing the cylinder along two diametrically opposed genetrices 32 which, at point 33, pass into the edge 34, as shown in dotted lines, which is included with respect to each generatrix so that the two cylinder halves 20 and 21 will form V-shaped notches in the upper part of the cylinder when the lower ends are moved toward each other.

Projecting pins 35 and 36 are provided on each cylinder half which are adapted to slide along a corresponding edge of the cam disc 24 whereby the cylinder 15 and the bag 18 are automatically centered. It will be observed that the upper part of each lug 27 and 28 is provided with a hole 37 receiving the respective ends of the tension spring 31. Thus, the tension spring 31 tends to contract the top parts of the two cylinder halves 20 and 21 and to widen the bottom surface thereof when the cylinder is lifted out of the bag 18. The cam disc 24 also supports the tubular headed guides 17 which comprise two rivets disposed near the base surface of the cam disc 24, and which functions to engage in the recesses 16 of the angle-shaped arm 14.

The mode of operation of the present invention is as follows: A plastic bag 18, or the like, is drawn over the outside of the bottom of the press cylinder 15 after which the bag and cylinder are placed and centered in the collar 19 while, simultaneously, the tubular guides 17 engage in the corresponding recesses 16. Thereafter, household waste material may be placed in the bag 18 from time to time whereupon the door is closed and the compression cycle performed. When the cylinder 15 is filled it is lifted out of the bag 18 by means of the handle 23. Thereafter, the bag with its waste content is removed for disposal. A new bag 18 is then drawn over the outside of the bottom of the press cylinder 15 and the compactor is ready for use again to receive household waste.

What is claimed is:

1. In a household compactor having a press unit and a bed plate, said bed plate being movable between two positions, one position being in vertical alignment with said press unit and the other position being a condition in which said bed plate is entirely removed from said press unit; the invention comprising a detachable hollow cylinder, means mounting said cylinder above said bed plate, a flexible container surrounding at least the bottom of said cylinder, the latter constituting two cylinder halves, said cylinder being divided along diametrically opposite generatrices which in the upper part pass into V-shaped notches, each cylinder half being provided with two lugs, each of said lugs co-acting with the corresponding lug of the other cylinder half, said co-acting lugs being pivotable in pairs about a common shaft, and a spring interconnecting the co-acting lugs whereby a force is applied thereto so that the ends of the cylinder halves facing said bed plate move laterally to form a larger spacing therebetween than the spacing between the ends at the opposite ends of said cylinder halves.

2. A compactor as claimed in claim 1 further comprising at least one cam disc supported by said shaft, said cam disc being triangular-shaped, and each cylinder half being provided with two pins adapted to slide on an edge of the respective disc during the pivoting movement of the cylinder halves.

3. A compactor as claimed in claim 2 further comprising a guide member, said cam disc supporting said guide member whereby the latter retains said cylinder in the correct position on said bed plate.

4. A compactor as claimed in claim 2 wherein said cylinder is provided with a handle by means of which said cylinder can be lifted selectively out of said container.

5. The combination as claimed in claim 1 wherein said flexible container is a plastic bag.

* * * * *